US006013422A

United States Patent [19]

Price

[11] Patent Number: 6,013,422

[45] Date of Patent: Jan. 11, 2000

[54] METHOD OF PROCESSING COLOR REVERSAL FILMS WITH REDUCED IRON RETENTION

[75] Inventor: Harry J. Price, Webster, N.Y.

[73] Assignee: Eastman Kodak Company, Rochester, N.Y.

[21] Appl. No.: 09/283,396

[22] Filed: Apr. 1, 1999

[51] Int. Cl.[7] ..... G03C 7/42

[52] U.S. Cl. ..... 430/393; 430/430; 430/455

[58] Field of Search ..... 430/393, 430, 430/455

[56] References Cited

U.S. PATENT DOCUMENTS

| | | | |
|---|---|---|---|
| 5,250,401 | 10/1993 | Okada et al. | 430/393 |
| 5,334,491 | 8/1994 | Foster et al. | 430/430 |
| 5,350,668 | 9/1994 | Abe et al. | 430/393 |
| 5,585,226 | 12/1996 | Strickland et al. | 430/393 |
| 5,652,085 | 7/1997 | Wilson et al. | 430/393 |
| 5,912,107 | 6/1999 | Dickerson et al. | 430/419 |
| 5,932,398 | 8/1999 | Fitterman et al. | 430/403 |

FOREIGN PATENT DOCUMENTS

| | | |
|---|---|---|
| 0 595 102 A1 | 4/1994 | European Pat. Off. . |
| 0 851 287 A2 | 1/1998 | European Pat. Off. . |
| 6130604 | of 0000 | Japan . |
| 6161063 | of 0000 | Japan . |

OTHER PUBLICATIONS

JP Abstract—6130587 A, May 13, 1994.

*Primary Examiner*—Hoa Van Le
*Attorney, Agent, or Firm*—J. Lanny Tucker

[57] ABSTRACT

Color reversal photographic elements can be effectively processed to provide color positive images using biodegradable bleaching compositions when the following fixing compositions contain an uncomplexed aminodisuccinic acid additive. The presence of the additive in the fixing composition seems to reduce the retained iron from use of the biodegradable bleaching composition, thereby reducing yellow stain and other undesirable effects in the color images, and iron precipitates in the fixing bath.

20 Claims, No Drawings

METHOD OF PROCESSING COLOR REVERSAL FILMS WITH REDUCED IRON RETENTION

FIELD OF THE INVENTION

This invention relates to a method of providing a color positive photographic image in color reversal films in photoprocessing. Thus, this invention relates to the photographic industry, and to photochemical processing in particular.

BACKGROUND OF THE INVENTION

The conventional image-forming process of silver halide photography includes imagewise exposure of a color photographic silver halide recording material to actinic radiation (such as actinic light), and the eventual manifestation of a useable image by wet photochemical processing of that exposed material. A fundamental step of photochemical processing is the treatment of the material with one or more developing agents to reduce silver halide to silver metal. The useful color image consists of one or more images in organic dyes produced from an oxidized developing agent formed wherever silver halide is reduced to metallic silver.

To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing agent in what is known as a fixing step. Oxidation is achieved with an oxidizing agent, commonly known as a bleaching agent.

One commercially important process intended for color reversal photographic films useful for providing positive color images, can include the following sequence of processing steps: first (or black-and-white) development, washing, reversal reexposure, color development, bleaching, fixing, washing and/or stabilizing. Another useful process has the same steps, but stabilizing is carried out between color development and bleaching. Such conventional steps are described, for example, in U.S. Pat. No. 4,921,779 (Cullinan et al), U.S. Pat. No. 4,975,356 (Cullinan et al), U.S. Pat. No. 5,037,725 (Cullinan et al), U.S. Pat. No. 5,523,195 (Darmon et al) and U.S. Pat. No. 5,552,264 (Cullinan et al).

The most common bleaching agents are complexes of ferric ion and various organic ligands (such as aminopolycarboxylic acids), of which there are hundreds of possibilities, all with varying bleaching activities and biodegradability. Common organic ligands used as part of bleaching agents for color film processing include ethylenediaminetetraacetic acid (EDTA), 1,3-propylenediaminetetraacetic acid (PDTA) and nitrilotriacetic acid (NTA).

U.S. Pat. No. 4,294,914 (Fyson) describes bleaching and bleach-fixing compositions and a processing method using a ferric complex of one of several alkyliminodiacetic acids, which are known to be more biodegradable than other common organic ligands such as EDTA. Other bleaching agents using similar organic ligands are described in U.S. Pat. No. 5,061,608 (Foster et al) in which the bleaching agent is advantageously combined with specific aliphatic carboxylic acids to reduce dye stains. U.S. Pat. No. 5,334,491 (Foster et al) also describes the use of similar biodegradable bleaching agents in combination with specific levels of bromide ion.

In processes utilizing methyliminodiacetic acid (MIDA) as the bleaching agent ligand, iron-MIDA dissociation may occur in the wash bath. This rust formation must be controlled by preventing the dissociation of MIDA from ferric ion. In copending and commonly assigned U.S. Ser. No. 08/795,885, filed Feb. 6, 1997, by Foster, a method of photographic processing is described wherein "anti-rust" agents are included in the bleaching solutions in order to control the dissociation of MIDA and similar ligands from ferric ion. Such agents are defined as organic phosphonic or phosphinic acids or salts thereof and were found to be highly effective. However, the "loading" of photographic bleaching solutions with yet another chemical is not the best way to solve such problems, and can create even further concerns, such as environmental problems.

Fixing is typically carried out after bleaching using a fixing composition that includes one or more fixing agents such as thiosulfate or thiocyanate salts. Both ammonium and sodium salts are known.

For processing color negative photographic films, bleaching compositions containing iron complexes of MIDA and other biodegradable ligands have been used successfully. However, it is has been discovered that such compositions cannot be successfully used to bleach color reversal films because of the less than desirable stability of the color images obtained therefrom. In some of those types of films, the magenta dye forming color coupler leaves a yellow background stain during long term keeping if the films are processed using MIDA-based bleaching compositions. This is believed to occur because of retained iron in the films, which iron may facilitate conversion of a stabilized form of the magenta dye forming coupler to yellow dye.

Thus, while there is a need in the industry to use more biodegradable bleaching compositions to process color reversal films, this need has not yet been met without resulting yellow dye stain in such films. There is a need to provide this advance in the art while reducing the presence of yellow dye stain and retained iron in the processed color reversal films.

SUMMARY OF THE INVENTION

The problems with known photographic photoprocessing methods are overcome with the use of the present invention.

This invention provides a method for providing a color image comprising the steps of:

A) bleaching an imagewise exposed and color developed color reversal silver halide element using a photographic bleaching composition comprising as bleaching agent, a ferric chelate of a biodegradable aminopolycarboxylic acid chelating ligand, and B) at least after step A, fixing the photographic element with a photographic fixing composition comprising a fixing agent and at least 0.01 mol/l of an uncomplexed aminodisuccinic acid.

The advantages of this invention are several. The color reversal elements can be processed, if desired, using more environmentally acceptable bleaching compositions. In other words, more biodegradable bleaching compositions can be used, particularly those including a ferric complex of MIDA as a bleaching agent. When such compositions are used for bleaching, the presence of the uncomplexed aminodisuccinic acid in the fixing composition inhibits the formation of yellow dye stain by reducing iron retained in the element after bleaching.

In addition, the use of the uncomplexed aminodisuccinic acid in the fixing composition was observed to reduce the formation of iron hydroxides and iron oxides in the processing tank used for fixing.

DETAILED DESCRIPTION OF THE INVENTION

The method of this invention provides a color positive image in what are known in the art as color reversal elements. After such elements are imagewise exposed and subjected to a first development and a color development, they are bleached and fixed to remove silver.

Bleaching is carried out in a bleaching step using one or more biodegradable bleaching agents that are ferric complexes of one or more biodegradable aminopolycarboxylic acid chelating ligands. The resulting ferric ion complexes can be binary complexes, meaning the ferric ion is complexed to one or more molecules of the same biodegradable chelating ligand, or ternary complexes in which the ferric ion is complexed to two molecules of two distinct biodegradable chelating ligands, similar to those complexes described for example in U.S. Pat. No. 5,670,305 (Gordon et al). A mixture of multiple binary or ternary ferric ion complexes can be present in the bleaching composition providing multiple biodegradable ferric bleaching agents. There may also be present a small quantity of non-biodegradable bleaching agents, of which there are hundreds of possibilities known in the art, as long as the quantity of such bleaching agents does not produce the yellow dye stain problem described above. Typically, such non-biodegradable ferric ion bleaching agents could be present in an amount of less than 0.1 mol/l.

There are many known classes of biodegradable aminopolycarboxylic acid chelating ligands that can be used to form biodegradable ferric ion bleaching agents. A preferred class are iminodiacetic acid and its derivatives (or salts thereof). Preferred chelating ligands are alkyliminodiacetic acids that have a substituted or unsubstituted alkyl group having 1 to 6 carbon atoms (such as methyl, ethyl, n-propyl, isopropyl and t-butyl). Particularly useful alkyliminodiacetic acids are methyliminodiacetic acid (MIDA) and ethyliminodiacetic acid (EIDA), and MIDA is the most preferred. These ligands can be used in the free acid form or as alkali metal (for example, sodium and potassium) or ammonium salts. These and other chelating ligands of this class can be represented by Structure I:

I

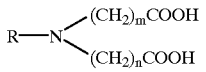

wherein m and n are independently 1, 2 or 3, and preferably each is 1. R is hydrogen, a substituted or unsubstituted alkyl group (having 1 to 10 carbon atoms), a substituted or unsubstituted aryl groups (having 6 to 10 carbon atoms in the aromatic ring), or a substituted or unsubstituted heterocyclic group having from 5 to 10 carbon and heteroatoms (nitrogen, sulfur or oxygen). Preferably, R is hydrogen or a substituted or unsubstituted alkyl group having 1 to 3 carbon atoms, and more preferably, it is hydrogen, methyl or ethyl.

Substituents that can be present in the alkyl, aryl and heterocyclic group include any monovalent moiety that does not bind to ferric ion, such as alkoxy (having 1 to 6 carbon atoms), amino, carboxy, phosphono, sulfo, —$SR_1$, —$CONR_2R_3$, and others readily apparent to one skilled in the art, wherein $R_1$ through $R_3$ independently represent hydrogen or a substituted or unsubstituted alkyl group as described above for R.

Useful chelating ligands within the scope of structure I include:

1

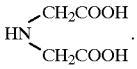

2

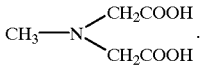

3

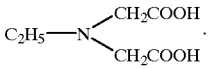

4

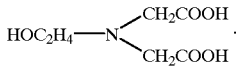

5

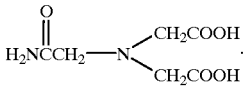

6

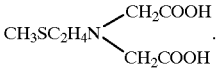

7

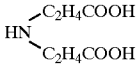

8

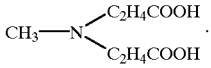

9

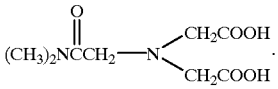

Another class of biodegradable aminopolycarboxylic acid chelating ligands useful to form bleaching agents can be represented by Structure II:

II

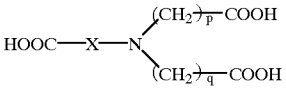

wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group. If substituted, such substituents can be those defined above for the ligands of Structure I. Preferably, X is a substituted or unsubstituted alkylene group of 1 to 3 carbon atoms. These ligands can also be used in the form of alkali metal or ammonium salts.

Representative chelating ligands within the scope of Structure II include:

1

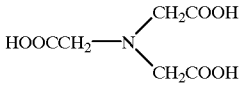

-continued

2

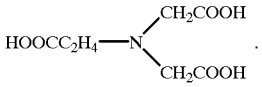

3

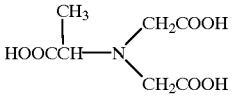

4

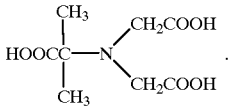

5

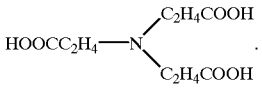

6

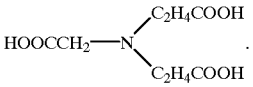

Still another useful class of biodegradable chelating ligands are aminodisuccinic and aminomonosuccinic acids (or salts thereof). Aminodisuccinic acids are compounds having one or more nitrogen atoms (preferably two or more nitrogen atoms) and preferably two of the nitrogen atoms are bonded to a succinic acid group (or salt thereof). Preferred chelating ligands have at least two nitrogen atoms, preferably no more than ten nitrogen atoms, and more preferably, no more than 6 nitrogen atoms. The remaining nitrogen atoms (not attached to a succinic acid group) are preferably substituted with hydrogen atoms only, but other substituents can also be present. Most preferably, the succinic acid group(s) are attached to terminal nitrogen atoms (meaning first or last nitrogens in the compounds). More details about such chelating ligands including representative chelating ligands are provided in U.S. Pat. No. 5,652,085 (Wilson et al), incorporated herein by reference. Ethylenediamine-N, N'-disuccinic acid (EDDS) is most preferred in this class of compounds. All isomers are useful, including the [S,S] isomer, and the isomers can be used singly or in mixtures.

Aminomonosuccinic acids (or salts thereof) are compounds having at least one nitrogen atom to which a succinic acid (or salt) group is attached. Otherwise, the compounds are defined similarly to the aminodisuccinic acids described above. U.S. Pat. No. 5,652,085 (noted above) also provides more details about such compounds, particularly the polyamino monosuccinic acids. Ethylenediamine monosuccinic acid (EDMS) is preferred in this class of chelating ligands.

Mixtures of bleaching agents that are ferric ion binary or ternary complexes of EDDS and EDMS are also useful in the practice of this invention.

Still other useful biodegradable chelating ligands include, but are not limited to, alaninediacetic acid, β-alaninediacetic acid (ADA), nitrilotriacetic acid (NTA), glycinesuccinic acid (GSA) and 2-pyridylmethyliminodiacetic acid.

A particularly useful class of bleaching agents are ternary complexes of ferric ion and one biodegradable chelating ligand as described above and a second chelating ligand that is an aromatic carboxylic acid comprising at least one carboxyl group and an aromatic nitrogen heterocycle. Such aromatic carboxylic acids are also preferably biodegradable. Such ternary ferric complexes are described in more detail in U.S. Pat. No. 5,582,958 (Buchanan et al), incorporated herein by reference.

More specifically, the useful aromatic chelating ligands include substituted or unsubstituted 2-pyridinecarboxylic acids and substituted or unsubstituted 2,6-pyridinedicarboxylic acids (or equivalent salts). The substituents that may be on the pyridinyl ring include substituted or unsubstituted alkyl (for example having up to 10 carbon atoms), substituted or unsubstituted cycloalkyl (for example 5 to 7 carbon atoms in the ring) or substituted or unsubstituted aryl groups (for example substituted or unsubstituted phenyl and naphthyl), hydroxy, nitro, sulfo, amino, carboxy, sulfamoyl, sulfonamide, phospho, halo or any other group that does not interfere with ferric ion ternary complex formation, stability, solubility or catalytic activity. The substituents can also be the atoms necessary to form a 5- to 7-membered fused ring with the pyridinyl nucleus.

The preferred chelating ligands of this type are represented by the following structures:

(III)

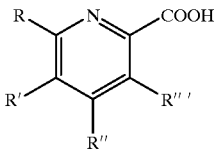

and (IV)

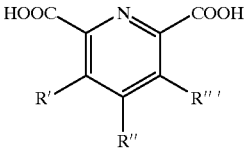

wherein R, R', R" and R'" are independently hydrogen, a substituted or unsubstituted alkyl of 1 to 5 carbon atoms, substituted or unsubstituted aryl group of 6 to 10 carbon atoms, a substituted or unsubstituted cycloalkyl of 5 to 10 carbon atoms, hydroxy, nitro, sulfo, amino, carboxy, sulfamoyl, sulfonamido, phospho or halo (such as chloro or bromo), or any two of R, R', R" and R'" can comprise the carbon atoms necessary to form a substituted or unsubstituted 5 to 7-membered ring fused with the pyridinyl nucleus.

Preferably, R, R', R" and R'" are independently hydrogen, hydroxy or carboxy. The most preferred chelating ligands are unsubstituted 2-pyridinecarboxylic acid and 2,6-pyridinedicarboxylic acid.

It should be understood that salts of these compounds are equally useful. Useful aromatic carboxylic acids and their salts are also described in various publications, including Japanese Kokai 51-07930 (noted above), EP-A-0 329 088 (noted above) and *J. Chem. Soc. Dalton Trans.,* 619 (1986).

These chelating ligands can be obtained from a number of commercial sources or prepared using conventional procedures and starting materials (see for example, Syper et al, *Tetrahedron,* 36, 123–129, 1980 and Bradshaw et al, *J. Am. Chem. Soc.,* 102(2), 467–74, 1980).

Where ternary complexes are used as bleaching agents, and the aromatic carboxylic acids of Structure III or IV are included as one of the chelating ligands, the mol ratio of the aromatic chelating ligand to ferric ion is generally at least 0.6:1, and the mol ratio of the other chelating ligand to ferric ion is at least 1:1.

Preferred ternary bleaching agents are ferric ion complexes of methyliminodiacetic acid (MIDA) and 2,6-pyridinedicarboxylic acid (PDCA), and nitrilotriacetic acid (NTA) and PDCA.

The iron salts used to form bleaching agents in the practice of this invention are generally ferric ion salts which provide a suitable amount of ferric ion for complexation with the ligands defined below. Useful ferric salts include, but are not limited to, ferric nitrate nonahydrate, ferric ammonium sulfate, ferric oxide, ferric sulfate and ferric chloride. Ferric nitrate is preferred. These salts can be provided in any suitable form and are available from a number of commercial sources.

As used herein, the terms "biodegradable" or "biodegradability" refer to at least 80% decomposition in the standard test protocol specified by the Organization for Economic Cooperation and Development (OECD), OECD 301B "Ready Biodegradability: Modified Sturm Test" which is well known in the photographic processing art.

It is not necessary that the ferric ion and the biodegradable chelating ligand(s) be present in the bleaching composition in stoichiometric proportions. It is preferred, however, that the molar ratio of the total chelating ligands to ferric iron be from about 1:1 to about 5:1. In a more preferred embodiment, the ratio is about 1:1 to about 2.5:1 moles of total chelating ligands per mole of ferric ion for the preferred chelating ligands identified above by Structure I and II.

Generally speaking, the iron is present in the bleaching composition in an amount of at least 0.001 mol/l, and preferably at least 0.1 mol/l, and generally up to 1 mol/l, and preferably up to 0.4 mol/l.

The bleaching agents are generally provided for the present invention by mixing a ferric ion compound (typically a water-soluble salt) with the desired chelating ligands in an aqueous solution. The pH of the solution is adjusted using appropriate acids or bases.

In preferred embodiments, a rehalogenating agent, such as chloride or bromide ions, is also present in the bleaching composition. The rehalogenating agent can be present in any effective amount, with useful amounts typically being at least about 0.1 mol/l, and preferably at least about 0.2 mol/l. Bromide ions are preferred, especially when the emulsions being processed are predominantly silver bromide. Chloride or bromide ions can be present with various cations including potassium, sodium or ammonium ions.

The bleaching composition can also include other addenda that may be useful in either working strength bleaching solutions, replenishers or regenerators, such as buffers, optical brighteners, whitening agents, preservatives (such as sulfites), metal sequestering agents, anti-scumming agents, organic antioxidants, biocides, anti-fungal agents, and anti-foam agents.

Useful buffers include acetic acid, propionic acid, succinic acid, maleic acid, malonic acid, tartaric acid, and other water-soluble aliphatic or aromatic carboxylic acids known in the art. Acetic acid is preferred. Other buffers, such as borates and carbonates can be used if desired. The bleaching compositions are aqueous acidic solutions preferably having a pH of from about 2 to about 5, but a different pH can be used if desired. A preferred pH is in the range of from about 2.5 to about 4.5. Alternatively, the compositions can be formulated as dry powders, granules or tablets that upon dissolution in water have the noted pH.

The bleaching compositions described herein can also be bleach-fixing compositions that include one or more fixing agents as well as the noted bleaching agents. Useful fixing agents are described below. Preferably, however, the bleaching compositions contain no photochemically active amount of a fixing agent, and thusly are not considered bleach-fixing compositions.

The fixing composition described herein is used at least after the bleaching step. If desired, more than one fixing step can be used, and one or more of those steps can precede the bleaching step as long as one fixing step follows the bleaching step. One or more intermediate washing steps can separate the bleaching and fixing steps if desired.

The useful photographic fixing composition is an aqueous composition containing one or more useful fixing agents, with or without fixing accelerators. Useful fixing agents include, but are not limited to, sulfites, thiocyanates, thiosulfates, and mixtures thereof. Fixing accelerators include, but are not limited to, thioethers, and mercaptotriazoles. The fixing agents can be present as thiosulfate or thiocyanate salts (that is alkali metal or ammonium salts) as is well known in the art. Mixtures of at least one thiosulfate and at least one thiocyanate may be particularly useful in some methods of the invention, especially when more rapid fixing is desired.

The fixing solution can include other addenda commonly useful in such solutions for various purposes, including buffers, metal sequestering agents, and electron transfer agents.

It is essential however, that the fixing composition including one or more uncomplexed aminodisuccinic acids that have one or more nitrogen atoms, and one or more of the nitrogen atoms are bonded to one or two succinic acid groups (or salts thereof). Such compounds include both monoamino disuccinic acids (or salts thereof) and polyamino disuccinic acids (or salts thereof).

Some compounds have at least two nitrogen atoms, preferably no more than ten nitrogen atoms, and more preferably, no more than 6 nitrogen atoms. The remaining nitrogen atoms (not attached to a succinic acid group) are preferably substituted with hydrogen atoms only, but other substituents can also be present. Most preferably, the succinic acid group(s) are attached to terminal nitrogen atoms (meaning first or last nitrogens in the compounds). More details about such compounds and their preparation are provided in U.S. Pat. No. 5,652,085 (noted above).

Any monoamino disuccinic acid or polyamino disuccinic acid compound can be used as an uncomplexed additive to the fixing composition as long as it effectively reduces residual iron during fixing to a desired level using the bleaching agents described above and otherwise standard Process E-6 processing conditions and solutions.

Representative compounds of this type that are used as uncomplexed "additives" in the fixing composition according to the present invention include, but are not limited to, ethylenediamine-N,N'-disuccinic acid (EDDS), diethylenetriamine-N,N"-disuccinic acid, triethylenetetraamine-N,N'"-disuccinic acid, 1,6-hexamethylenediamine-N,N'-disuccinic acid, tetraethylenepentamine-N,N""-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, ethylenebis(oxyethylenenitrilo)-N,N'-disuccinic acid, methyliminodisuccinic acid, and iminodisuccinic acid (IDSA). EDDS and IDSA are preferred. Racemic mixtures of the uncomplexed additives can be used, or essentially pure isomers can be used. For example, the [S,S] isomer of EDDS may be useful in the practice of this invention.

By "uncomplexed" is meant that the aminodisuccinic acid is present in "free" form (or as a salt), and not in substantial complexation with ferric or other metal ions. Obviously, if a ferric ion complex of an aminodisuccinic acid bleaching agent is used in the bleaching step, some of it may be carried by the processed element over into the fixing bath. Such carry-over amounts would not appreciably affect the performance of the present invention.

Other uncomplexed biodegradable or non-biodegradable polycarboxylic acids (for example, citric acid, nitrilotriacetic acid, tartaric acid, or ethylenediaminetetraacetic acid) can be included in the fixing composition as well as long as sufficient aminodisuccinic acid(s) are present to achieve the desired reduction in residual iron during fixing.

The amount of fixing agent useful in the fixing composition is well known in the art, and is generally at least 0.5 mol/l. Other details about fixing solutions are also well known in the art to a skilled photographic processing chemist. The compositions can include but are not limited to, buffers, biocides, anti-fungal agents, optical brighteners, preservatives (such as sulfites), organic antioxidants, anti-scumming agents, and sequestering agents.

The amount of the one or more uncomplexed aminodisuccinic acids present in the fixing composition is at least 0.01 mol/l, and preferably at least 0.03 mol/l. The upper amount is generally 0.2 mol/l, and preferably 0.1 mol/l.

The bleaching and fixing compositions described herein can be used to process the color reversal elements using any suitable processing equipment and conditions including conventional processing equipment and conditions (such as large scale processors or minilab processors). Generally, the processing equipment includes a series of tanks containing the various processing solutions in sequence. In most of such processing apparatus, the processed materials are generally immersed in the processing solutions. The volumes of the processing solutions can vary from less than 100 ml to 50 liters. Such processing equipment may also include rollers to guide the photographic material through the various processing tanks.

Bleaching according to this invention can be carried out in less than 8 minutes, but even shorter times are possible under certain conditions. For example, the time may be within 6 minutes, and more preferably within 5 minutes. Bleaching temperatures are generally from about 20 to about 50° C.

Fixing can be carried out within 4 minutes, and even shorter times may be desirable under certain conditions. Fixing temperatures can generally be from about 20 to about 50° C.

The bleaching compositions described above can be used as working tank solutions or replenishers, and can be in diluted or concentrated form for use as a regenerator and/or replenisher. The fixing solutions described above can be similarly prepared and used. Both solutions can be replenished at a replenishment rate of up to 1000 ml/m$^2$. Replenishment can be accomplished directly into the processing tank, or a portion of overflow can be mixed with a regenerator to provide a suitable regenerated replenisher. The regenerator concentrate itself can be delivered directly to the processing tank.

Each of the bleaching and fixing steps can be carried out in one or more tanks or stages arranged in countercurrent or concurrent flow. Any fixing method can be used, including immersing the element in the fixing composition (with or without agitation or circulation), bringing the element into contact with a web or drum surface that is wet in such a way that the fixing composition is brought into contact with the element, or by applying the fixing composition to the element by high velocity jet or spray.

During fixing, the fixing composition in the processor may accumulate dissolved silver halide, and other substances that are extracted from the processed photographic element. Such materials, and particularly silver halide, can be removed using known means, such as ion exchange, electroysis, electrodialysis and precipitation.

Color reversal elements are also subjected to several other processing steps and compositions in order to provide the desired color positive image. The details of such processing steps and compositions including first development, reversal step, color development, pre-bleaching or conditioning, post-fixing stabilizing, and the color photographic elements processed therein, including emulsions, supports and other details thereof, are well known from hundreds of publications, some of which are listed in *Research Disclosure,* publication 38957, pages 592–639, September 1996, incorporated herein by reference. *Research Disclosure* is a publication of Kenneth Mason Publications Ltd., Dudley House, 12 North Street, Emsworth, Hampshire PO 10 7DQ England.

Since the bleaching and fixing steps are separate steps in an overall image-forming method of this invention, any processing sequence can be used for processing the color reversal elements. For example, two conventional processing methods are known as Process E-6 and Process K-14 for color reversal films.

More preferably, the typical sequence of steps includes first development (black-and-white development), reversal processing step, color developing, bleaching, fixing, and stabilizing. There may be various washing steps between other steps, as well as a pre-bleach step or conditioning step before bleaching. Alternatively, stabilizing can occur between color developing and bleaching. Many details of such processes are provided in U.S. Pat. No. 5,552,264 (Cullinan et al), incorporated herein by reference. Other details are provided in *Research Disclosure,* publication 38957 (noted above), and references noted therein.

Color reversal films used in the practice of this invention are comprised of a Support having thereon a plurality of photosensitive silver halide emulsion layers that can contain any conventional silver halide (or mixture thereof). Such films generally have silver halide emulsions having at least 1 mol % iodide based on total silver.

Useful supports are well known and include polyester films, polycarbonate films and cellulose acetate films. The silver halide layers include conventional binder materials, and other conventional addenda. Some specific commercially available color reversal photographic films that can be processed using this invention include EKTACHROME and KODACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (Imation).

Color reversal films particularly useful in the practice of this invention include those containing what are known as arylpyrazolone type of magenta dye forming color couplers. Such color couplers are well known in the art. One such compound is described in U.S. Pat. No. 5,037,725 (Cullinan et al).

A black-and-white composition used in the first development generally includes one or more black and white developing agents (such as dihydroxybenzenes or derivatives thereof, ascorbic acid or derivatives thereof, aminophenol and 3-pyrazolidone type developing agents) that are well known in the art, including U.S. Pat. No. 5,187,050 (Yamada et al), U.S. Pat. No. 5,683,859 (Nothnagle et al) and U.S. Pat. No. 5,702,875 (Opitz et al), all incorporated herein by reference. Dihydroxybenzenes and their derivatives (and salts), such as hydroquinone sulfonate, are preferred. It is particularly desirable to include a 3-pyrazolidone auxiliary developing agent. Such compounds are also described in U.S. Pat. No. 5,683,859 (noted above).

The black and white developing composition generally includes other chemicals common to black and white developers including, but not limited to, buffering agents (such as carbonates and bicarbonates), sulfite preservatives (including bisulfites and sulfites), anti-sludging agents, antifoggants, antioxidants, stabilizing agents, contrast-promoting agents, metal ion sequestering agents (such as polyphosphonic acids and aminopolycarboxylic acids and salts thereof), halides (such as iodide and bromide salts), hydroxides, and silver metal solvents (such as thiocyanates).

Photographic reversal compositions are also known in the art, including for example U.S. Pat. No. 3,617,282 (Bard et al) and U.S. Pat. No. 5,736,302 (Buongiorne et al), both incorporated herein by reference. Chemical components generally included therein include a source of stannous ions (such as stannous chloride, stannous bromide, stannous acetate and stannous fluoride), one or more metal ion chelating agents (such as polyphosphonic or polyphosphinic acids or aminocarboxylic acids or salts thereof, one or more biocides, hydroxides, surfactants, antioxidants, buffering agents, and stannous ion stabilizers (such as p-aminophenol).

The color development is generally accomplished with a color developing composition containing the chemical components conventionally used for that purpose, including color developing agents, buffering agents, metal ion sequestering agents, optical brighteners, halides, antioxidants, sulfites and other compounds readily apparent to one skilled in the art. Examples and amounts of such components are well known in the art, including for example U.S. Pat. No. 5,037,725 (Cullinan et al) and U.S. Pat. No. 5,552,264 (Cullinan et al), both incorporated herein by reference.

Another useful composition for color reversal processing is a composition that provides dye image stabilization. If in liquid form, this composition generally includes a dye stabilization compound (such as an alkali metal formaldehyde bisulfite, hexamethylenetetramine and various formaldehyde releasing compounds), buffering agents, bleach-accelerating compounds, secondary amines, preservatives, and metal sequestering agents. All of these compounds are well known in the art, including U.S. Pat. No. 4,839,262 (Schwartz), U.S. Pat. No. 4,921,779 (Cullinan et al), U.S. Pat. No. 5,037,725 (Cullinan et al), U.S. Pat. No. 5,523,195 (Darmon et al) and U.S. Pat. No. 5,552,264 (Cullinan et al), all incorporated herein by reference.

A final rinse composition generally has a pH of from about 5 to about 9 (in liquid form), and can include one or more surfactants (anionic, nonionic or both), biocides and buffering agents as is well known in the art. See for example, U.S. Pat. No. 3,545,970 (Giorgianni et al), U.S. Pat. No. 5,534,396 (McGuckin et al), U.S. Pat. No. 5,645,980 (McGuckin et al), U.S. Pat. No. 5,667,948 (McGuckin et al) and U.S. Pat. No. 5,716,765 (McGuckin et al), all of which are incorporated herein by reference.

All of the compositions useful in the practice of this invention can be provided in either working strength or concentrated form. If in the form of concentrates, suitable dilution before or during use would be readily apparent to one skilled in the art.

The following examples are provided to illustrate the invention, and not to be limiting in any fashion.

EXAMPLE 1

Processing Color Reversal Films

Samples of commercially available KODAK EKTACHROME ELITE II 100 Color Reversal Film were given a uniform high intensity exposure such that all silver halide was developed in the first development step of the conventional Process E-6 photoprocessing method. These film samples were then processed using conventional Process E-6 conditions, processing sequence (TABLE I) and processing solutions, except for the bleaching and fixing solutions (described below).

TABLE I

| PROCESSING STEP | PROCESSING COMPOSITION | PROCESSING TIME | PROCESSING TEMPERATURE |
|---|---|---|---|
| First Development | KODAK First Developer, Process E-6 | 360 seconds | 37° C. |
| Washing | Water | 120 seconds | 37° C. |
| Reversal bath | KODAK Process E-6 AR Reversal Bath & Replenisher | 120 seconds | 37° C. |
| Color development | KODAK Color Developer, Process E-6 | 360 seconds | 38° C. |
| Prebleaching | KODAK Prebleach Replenisher II, Process E-6 | 120 seconds | 37° C. |
| Bleaching | See below | 360 seconds | 37° C. |
| Fixing | See below | 240 seconds | 37° C. |
| Washing | Water | 240 seconds | 37° C. |
| Final rinsing | KODAK Final Rinse & Replenisher, Process E-6AR | 60 seconds | 37° C. |

The bleaching composition used in this example had the components listed in TABLE II:

TABLE II

| COMPONENT | AMOUNT |
|---|---|
| Water | 0.5 liter |
| Potassium MIDA (49.6%) | 250 g |
| Hydrobromic acid (49%) | 10.3 g |
| Ferric nitrate (39%) | 130 g |
| Acetic acid | 21 g |
| Ammonium bromide | 24.7 g |
| Potassium carbonate or nitric acid | to pH 4.25 |
| Water | to 1 liter |

Fixing was carried out using the standard commercially available KODAK Process E-6 Fixer solution to which some of the noted bleaching solution had been added to simulate a "seasoned" solution that would exist in a typical processor. The "seasoned" fixing solution contained 30% of the bleaching solution, by volume. Except for the Control A fixing solution, the tested fixing solutions also included an uncomplexed "additive" at 0.05 mol/l in an attempt to control yellow dye stain formation. After the samples were processed and dried, the amount of residual iron was measured in each using conventional X-ray fluorescence procedures. The results of these determinations are shown in the following TABLE III.

TABLE III

| Additive Compound | Residual Iron ($mg/m^2$ of film) |
|---|---|
| Control A: none | 100 |
| Invention: Ethylenediamine disuccinic acid (EDDS) | 9.7 |

TABLE III-continued

| Additive Compound | Residual Iron ($mg/m^2$ of film) |
|---|---|
| Invention: Iminodisuccinic acid (IDSA) | 8.6 |
| Control B: Citric acid | 11 |
| Control C: Ethylenediaminetetraacetic acid (EDTA) | 14 |
| Control D: Diethylenetriaminepentaacetic acid (DTPA) | 8.6 |
| Control E: 1,3-Propylenediaminetetraacetic acid (PDTA) | 17 |
| Control F: 2,6-Pyridinedicarboxylic acid (PDCA) | 51 |
| Control G: Ethylenediamine monosuccinic acid (EDMS) | 82 |
| Contol H: Methyliminodiacetic acid (MIDA) | 82 |
| Control I: Nitrilotriacetic acid (NTA) | 11 |

This example shows that when the ferric-MIDA bleaching composition was used, EDDS, IDSA and DTPA were the most effective additives to use in the fixing composition to reduce the retained iron. However, because ethylenediamine disuccinic acid (EDDS) and iminodisuccinic acid (IDSA) are biodegradable, they are useful in this invention, and DTPA is not.

EXAMPLE 2

Use of a Ternary Bleaching Agent

Samples of KODAK EKTACHROME Elite II 100 color reversal film were exposed and processed as described in Example 1 except for different bleaching and fixing compositions. The bleaching composition used was prepared by adding the components in the order shown in TABLE IV below. The bleaching agent was a ternary complex of ferric ion with MIDA and PDCA.

TABLE IV

| COMPONENT | AMOUNT |
|---|---|
| Water | 0.5 liters |
| 2,6-Pyridinedicarboxylic acid (PDCA) | 21.3 grams |
| Potassium hydroxide (45%) | 33.5 grams |
| $K_2$MIDA (49.6%) | 121.5 grams |
| Potassium bromide | 35.7 grams |
| Succinic acid | 18.8 grams |
| Ferric nitrate (39% sol.) | 92.25 grams |
| Succinic acid | 10.7 grams |
| Potassium carbonate or dilute nitric acid | to pH 3.9 |
| Water to make | 1 liter |

Various fixing solutions were used to process the film samples. Each fixing solution was like the standard Process E-6 fixing solution but additionally having some of the bleaching solution added to simulate a seasoned fixing solution as would exist in a processing machine. These simulated seasoned fixing solutions contained 30% bleach, by volume. Except for the Control A solution, each fixing solution also contained an uncomplexed "additive" at a level of 0.05 mol/l, which was added for the purpose of determining its effect on the amount of iron retained in the film.

After processing and drying, the amount of residual iron in each film sample was measured by X-ray fluorescence. The results are shown in the TABLE V below.

TABLE V

| ADDITIVE | Residual Iron ($mg/m^2$ of film) |
|---|---|
| Control A: (None) | 38.7 |
| Invention: EDDS | 2.16 |
| Control B: Citric acid | l0.8 |
| Control C: EDTA | 2.16 |
| Control D: DTPA | 2.16 |
| Control E: PDTA | 3.24 |
| Control F: EDMS | 33.3 |
| Control G: MIDA | 28.0 |
| Control H: NTA | 7.56 |

This example shows that when the ternary ferric ion-MIDA/PDCA bleaching agent was used, EDDS, EDTA and DTPA were the only additives in the fixing solution capable of reducing the retained iron to the lowest level. However, only EDDS is biodegradable and useful in the practice of this invention.

EXAMPLE 3

Levels of EDDS Additive in Fixing Solutions

Film samples were exposed and processed as described in Example 1. The same $Fe(MIDA)_2$ bleaching solution was used as in Example 1. Simulated seasoned fixing solutions were prepared similar to those in Example 1, but in this instance the only additive used in the fixing solution was EDDS, at various concentrations. The amounts of EDDS and the corresponding amounts of residual iron in the film samples are shown in TABLE VI below.

TABLE VI

| EDDS(mol/l) | Residual Iron ($mg/m^2$ of film) |
|---|---|
| None (control) | 108 |
| 0.01 | 82.1 |
| 0.02 | 59.4 |
| 0.04 | 22.7 |
| 0.06 | 2.16 |
| 0.08 | 2.16 |

In another experiment, film samples were exposed and processed as described in Example 2 using simulated seasoned fixers, each containing a different concentration of EDDS as the uncomplexed additive. TABLE VII below shows the EDDS concentrations in the fixing compositions and the corresponding amounts of residual iron in the film samples.

TABlE VII

| EDDS (mol/l) | Residual Iron ($mg/m^2$ of film) |
|---|---|
| None (control) | 51.8 |
| 0.01 | 29.2 |
| 0.02 | 10.8 |
| 0.03 | 4.32 |
| 0.04 | 3.24 |
| 0.05 | 2.16 |

This example establishes the preferred concentrations of the preferred uncomplexed aminopolycarboxylic acid to be added to fixing compositions useful in this invention for controlling the amount of retained iron in the color reversal films. When using a ferric ion-MIDA bleaching agent, the preferred amount of EDDS was 0.06 mol/l or more. When a ternary complex was used, the preferred amount of EDDS was 0.05 mol/l or more.

EXAMPLE 4

Use of Combination of Ligands in Fixing Solutions

An experiment was carried out similarly to that in Example 3, except that the seasoned fixing solutions each contained a combination of uncomplexed additives. The color reversal film samples were exposed and processed as described in Example 1. Simulated seasoned fixing solutions were prepared containing various amounts of both EDDS and citric acid as additives wherein the concentrations of both compounds were equal. The amounts of additives and the corresponding amounts of residual iron in the films are shown in TABLE VIII below.

TABLE VIII

| EDDS (mol/l) | Citric acid (mol/l) | Residual Iron (mg/m$^2$ of film) |
|---|---|---|
| None (control) | None (control) | 92.3 |
| 0.005 | 0.005 | 79.9 |
| 0.01 | 0.01 | 58.3 |
| 0.015 | 0.015 | 31.3 |
| 0.02 | 0.02 | 14.0 |
| 0.025 | 0.025 | 5.4 |
| 0.03 | 0.03 | 5.4 |

This example shows that EDDS can be used in combination with another additive such as citric acid to reduce the amount of retained iron in the film.

The invention has been described in detail with particular reference to preferred embodiments thereof, but it will be understood that variations and modifications can be effected within the spirit and scope of the invention.

I claim:

1. A method for providing a color image comprising the steps of:

A) bleaching an imagewise exposed and color developed color reversal silver halide photographic element using a photographic bleaching composition comprising as a bleaching agent, a ferric chelate of a biodegradable aminopolycarboxylic acid chelating ligand, and B) at least after step A, fixing said photographic element with photographic fixing composition comprising a fixing agent and at least 0.01 mol/l of an uncomplexed aminodisuccinic acid.

2. The method of claim 1 wherein said aminopolycarboxylic acid chelating ligand is an iminodiacetic acid or a derivative thereof, an aminodisuccinic acid, an aminomonosuccinic acid, alaninediacetic acid, β-alaninediacetic acid, nitrilotriacetic acid, or glycinesuccinic acid.

3. The method of claim 1 wherein said aminopolycarboxylic acid chelating ligand is represented by Structure I or II:

I

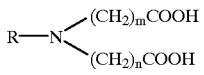

wherein m and n are independently 1, 2 or 3, R is hydrogen, a substituted or unsubstituted alkyl group, a substituted or unsubstituted aryl group, or a substituted or unsubstituted heterocyclic group having from 5 to 10 carbon and heteroatoms,

II

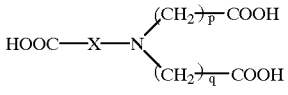

wherein p and q are independently 1, 2 and 3, the linking group X is any divalent group that does not bind ferric ion and does not cause the resulting ligand to be water-insoluble.

4. The method of claim 3 wherein the chelating ligands of Structure I include:

1

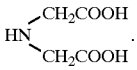

2

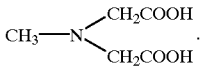

3

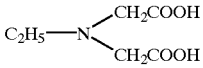

4

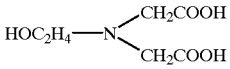

5

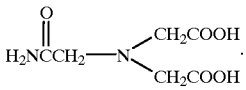

6

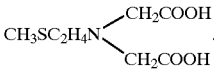

7

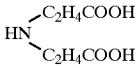

8

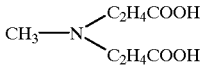

9

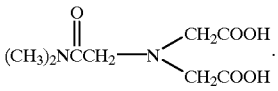

and the useful chelating ligands of Structure II include:

1

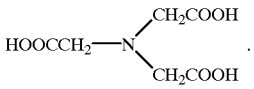

2

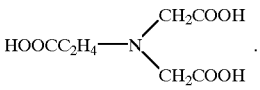

3

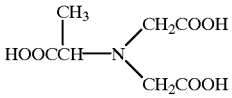

-continued

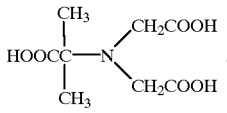

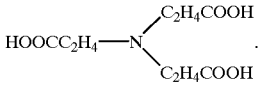

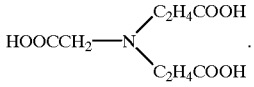

.

5. The method of claim 1 wherein said aminopolycarboxylic acid chelating ligand is methyliminodiacetic acid, iminodiacetic acid, or ethyliminodiacetic acid.

6. The method of claim 1 wherein ferric ion is present in said bleaching composition in an amount of at least 0.1 mol/l, and the molar ratio of said chelating ligand to ferric ion is at least 1:1.

7. The method of claim 1 wherein said bleaching agent is a ternary complex of ferric ion and two aminopolycarboxylic acid chelating ligands, at least one of which is a biodegradable chelating ligand.

8. The method of claim 7 wherein one of said chelating ligands is an aromatic carboxylic acid comprising at least one carboxylic acid group and an aromatic nitrogen heterocycle.

9. The method of claim 8 wherein said bleaching agent is a ternary complex of an iminodiacetic acid chelating ligand or a derivative thereof, or nitrilotriacetic acid, and a substituted or unsubstituted 2-pyridinecarboxylic acid or a substituted or unsubstituted 2,6-pyridinedicarboxylic acid.

10. The method of claim 1 wherein said fixing agent is a thiosulfate.

11. The method of claim 1 wherein said aminodisuccinic acid is present in said fixing composition in an amount of from about 0.01 to about 0.2 mol/l.

12. The method of claim 11 wherein said aminodisuccinic acid is present in said fixing composition in an amount of from about 0.03 to about 0.1 mol/l.

13. The method of claim 1 wherein said aminodisuccinic acid is ethylenediamine-N,N'-disuccinic acid, diethylenetriamine-N,N"-disuccinic acid, triethylenetetraamine-N,N'"-disuccinic acid, 1,6-hexamethylenediamine-N,N'-disuccinic acid, tetraethylenepentamine-N,N""-disuccinic acid, 2-hydroxypropylene-1,3-diamine-N,N'-disuccinic acid, 1,2-propylenediamine-N,N'-disuccinic acid, 1,3-propylenediamine-N,N'-disuccinic acid, cis-cyclohexanediamine-N,N'-disuccinic acid, trans-cyclohexanediamine-N,N'-disuccinic acid, methyliminodisuccinic acid, iminodisuccinic acid or ethylenebis(oxyethylenenitrilo)-N,N'-disuccinic acid, or a salt of any of the compounds.

14. The method of claim 13 wherein said aminodisuccinic acid is ethylenediamine-N,N'-disuccinic acid or iminodisuccinic acid, or a salt of either compound.

15. The method of claim 14 wherein said aminodisuccinic acid is the [S,S] isomer of ethylenediamine-N,N'-disuccinic acid.

16. The method of claim 1 wherein step A is carried out within 8 minutes and step B is carried out within 4 minutes.

17. The method of claim 1 wherein said processed color reversal silver halide element is a photographic film containing at least one magenta dye forming coupler of the arylpyrazolone class.

18. The method of claim 1 wherein step A is preceded by first development, reversal and color development steps.

19. A method for providing a positive color image comprising the steps of:

A) bleaching an imagewise exposed and color developed color reversal silver halide photographic film using a photographic bleaching composition comprising as a bleaching agent, a ferric chelate of an aminopolycarboxylic acid which is methyliminodiacetic acid or nitrilotriacetic acid, said ferric chelate being present in an amount of at least 0.1 mol/l, and B) at least after step A, fixing said photographic element with photographic fixing composition comprising a thiosulfate fixing agent and from about 0.03 to about 0.1 mol/l of uncomplexed ethylenediamine-N,N'-disuccinic acid or iminodisuccinic acid.

20. The method of claim 19 wherein said ferric chelate bleaching agent is a ternary complex of ferric ions, methyliminodiacetic acid or nitrilotriacetic acid and either 2-pyridinecarboxylic acid or 2,6-pyridinedicarboxylic acid.

* * * * *